US007950075B2

(12) United States Patent
Evans, Jr. et al.

(10) Patent No.: US 7,950,075 B2
(45) Date of Patent: May 31, 2011

(54) PROTECTIVE COVER FOR PREVENTING SPILLED LIQUIDS FROM FLOWING INTO DRAINS OR HOLES

(75) Inventors: R. Douglas Evans, Jr., Everett, PA (US); Patrick E. Healy, Gallitzin, PA (US); Matthew J. Huff, Claysburg, PA (US)

(73) Assignee: New Pig Corporation, Tipton, PA (US)

( * ) Notice: Subject to any disclaimer, the term of this patent is extended or adjusted under 35 U.S.C. 154(b) by 1225 days.

(21) Appl. No.: 11/584,849

(22) Filed: Oct. 23, 2006

(65) Prior Publication Data

US 2007/0033722 A1 Feb. 15, 2007

Related U.S. Application Data

(63) Continuation-in-part of application No. 11/189,660, filed on Jul. 26, 2005, now abandoned, which is a continuation-in-part of application No. 10/447,364, filed on May 28, 2003, now abandoned.

(51) Int. Cl.
*A47K 1/14* (2006.01)

(52) U.S. Cl. ..... 4/293

(58) Field of Classification Search ..... 4/293; 404/4; 405/52

See application file for complete search history.

(56) References Cited

U.S. PATENT DOCUMENTS

| | | | |
|---|---|---|---|
| 962,570 | A | 6/1910 | Hufschmidt |
| 1,622,850 | A | 3/1927 | Schacht |
| 1,742,369 | A | 1/1930 | Probst et al. |
| 1,825,499 | A | 9/1931 | Zorn |
| 1,912,312 | A | 5/1933 | Schacht |
| 4,031,676 | A | 6/1977 | Dally |
| 4,139,117 | A | 2/1979 | Dial |
| 4,208,469 | A | 6/1980 | Dial |
| 4,230,753 | A | 10/1980 | Sheyon |
| 4,765,775 | A | 8/1988 | Kroger |
| 4,799,821 | A | 1/1989 | Brodersen |
| 4,813,811 | A | 3/1989 | Adams |
| 4,838,732 | A | 6/1989 | Clark et al. |
| 4,981,391 | A | 1/1991 | Klementovich |
| 4,988,234 | A | 1/1991 | Henkel et al. |
| 5,236,281 | A | 8/1993 | Middleton |
| 5,379,555 | A | 1/1995 | Strieb et al. |
| 6,338,168 | B1 | 1/2002 | Valentine |
| 6,530,722 | B1 | 3/2003 | Shaw et al. |
| 2004/0157074 | A1 | 8/2004 | Hubbard |
| 2005/0170143 | A1 | 8/2005 | Yau |

FOREIGN PATENT DOCUMENTS

| | | | |
|---|---|---|---|
| DE | 202 10573 | U1 | 11/2002 |
| DE | 20 2004 019761 | U1 | 5/2006 |
| DE | 10 2007 017410 | A1 | 10/2008 |

OTHER PUBLICATIONS

New Pig Corporation, 1999 Product Catalog p. 81 for Drainblocker Drain Plug, 1 pg.

*Primary Examiner* — Lori Baker

(74) *Attorney, Agent, or Firm* — Benjamin T. Queen, II; Alka A. Patel, Esq.; Pietragallo Gordon Alfano Bosick & Raspanti, LLP

(57) ABSTRACT

A protective cover for drains and other holes is provided which prevents spills and unwanted liquids from flowing therein. The protective cover includes a durable backing layer and a pliable, tacky sealing layer adjacent a portion of the durable backing layer which conforms and adheres to a surface surrounding the drain to reduce or eliminate the flow of liquids into the drain. The pliable, tacky sealing layer can have a periphery inside the periphery of the durable backing layer.

20 Claims, 3 Drawing Sheets

PROTECTIVE COVER FOR PREVENTING SPILLED LIQUIDS FROM FLOWING INTO DRAINS OR HOLES

CROSS-REFERENCE TO RELATED APPLICATION

This application is a continuation-in-part of U.S. application Ser. No. 11/189,660 filed Jul. 26, 2005, which is a continuation-in-part of U.S. application Ser. No. 10/447,364 filed May 28, 2003, now abandoned, each of which are incorporated herein by reference.

FIELD OF THE INVENTION

The present invention is directed toward portable protective covers and, more particularly, toward a cover for protecting drains, holes and the like from spills and unwanted liquids.

BACKGROUND INFORMATION

It is often desirable to temporarily close off drains to prevent various liquids from flowing therein. Particularly, when handling hazardous liquids in the vicinity of a drain, such as a storm drain or manhole, it is desirable to temporarily seal off the drain to prevent any hazardous liquid that may be accidentally spilled on the ground from entering the drain. Some known methods of sealing off a drain to prevent the possible ingress of liquids include providing custom fitted ridged covers, utilizing manual or automatic cutoff valves, covering the drain with a flexible material (e.g., canvas) and covering the flexible material with dirt or sand, and utilizing a uniformly thick sheet of polyurethane, vinyls, and other pliable materials to cover the entire drain. However, these known methods of drain isolation have certain practical limitations to their usefulness.

Utilizing custom fitted ridged covers or cutoff valves requires extensive preparation and installation efforts. Manufacturing a custom fitted cover and/or installing cutoff valves are both time consuming endeavors. Neither a custom fitted cover nor an installed cutoff valve can be easily adapted for use in covering and isolating drains other than the one for which the cover or valve was specifically designed. Moreover, once a custom fitted cover or cutoff valve is in place in a drain or drain system, neither is readily removable and/or transportable to another location for use.

Utilizing a flexible material held in place by dirt or sand to seal off a drain also presents certain problems in that such a covering is difficult to work with and is cumbersome and time consuming to implement in emergency situations. The effective seal surrounding the drain is limited by the dirt or sand utilized to hold the flexible material in place, and is further limited in that the dirt or sand may be washed away or eroded during flooding. Such a drain covering has limited reusability and transportability, and the seal effectuated thereby has little resistance to the shear forces of onrushing liquids.

Uniformly thick sheets of polyurethane, vinyls, and other pliable materials exhibit useful reusability and transportability properties, and are generally reliable when utilized to cover small drains or holes. However, when utilized to cover larger drains, such as those on the order of 30×30 inches and above, the large polyurethane/vinyl sheets required to cover such drains become heavy and difficult to transport and implement in emergency situations.

The present invention is directed toward overcoming one or more the above-mentioned problems.

SUMMARY OF THE INVENTION

A device for providing a temporary protective cover for drains and other holes to prevent spills and other liquids from flowing therein is provided. The protective cover of the present invention includes a durable backing layer and a pliable, tacky sealing layer adjacent the backing layer. The backing layer can include a thickened portion provided adjacent to a peripheral edge of the backing layer. The pliable, tacky sealing layer can be inherently tacky or can include a tackifier thereon such that it may adhere to a surface surrounding the drain to prevent the flow of liquid therebetween.

The protective cover of the present invention is positionable over a drain or other hole such that an exposed surface of the pliable, tacky sealing layer contacts a portion of the surface surrounding the drain or other hole, whereby the protective cover device is adapted for preventing a liquid from passing through the drain or other hole. For safety purposes, at least the top surface of the protective cover may include a color that is highly visible.

An aspect of the present invention is to provide a protective cover for installation over a drain comprising a durable backing layer having a periphery, and a pliable, tacky sealing layer adjacent a portion of the durable backing layer structured and arranged to block spills from entering the drain having a periphery inside the periphery of the durable backing layer.

Another aspect of the present invention is to provide a protective cover for installation over a drain comprising a durable backing layer having an interior region and a periphery wherein at least a portion of the interior region has a thickness less than a thickness of the backing layer adjacent its periphery, and a pliable, tacky sealing layer adjacent a portion of the durable backing layer structured and arranged to block spills from entering the drain.

A further aspect of the present invention is to provide a protective cover for installation over a drain comprising a durable rubber backing layer having a periphery and a thickened portion adjacent the periphery, and a pliable, tacky urethane sealing layer structured and arranged to block spills from entering the drain adjacent a portion of the durable rubber backing layer, the pliable, tacky urethane sealing layer having a periphery inside the periphery of the durable rubber backing layer.

These and other aspects of the present invention will be more apparent from the following description.

DETAILED DESCRIPTION

The present invention provides a protective cover which prevents spills and/or other unwanted liquids from flowing into drains or holes. At least a portion of the liquid is prevented from flowing into a drain or hole by the protective cover. The spill or unwanted liquid may be any flowable material such as hazardous liquids, storm water, hydrocarbons, chemicals, debris, dirt, trash and the like which are desired to be kept out of drains and the like. As used herein, the term "drains or holes" means any drain, hole or other opening such as a vent, manhole or the like through which it is desired to prevent the flow of spills or unwanted liquids.

Figure 1:
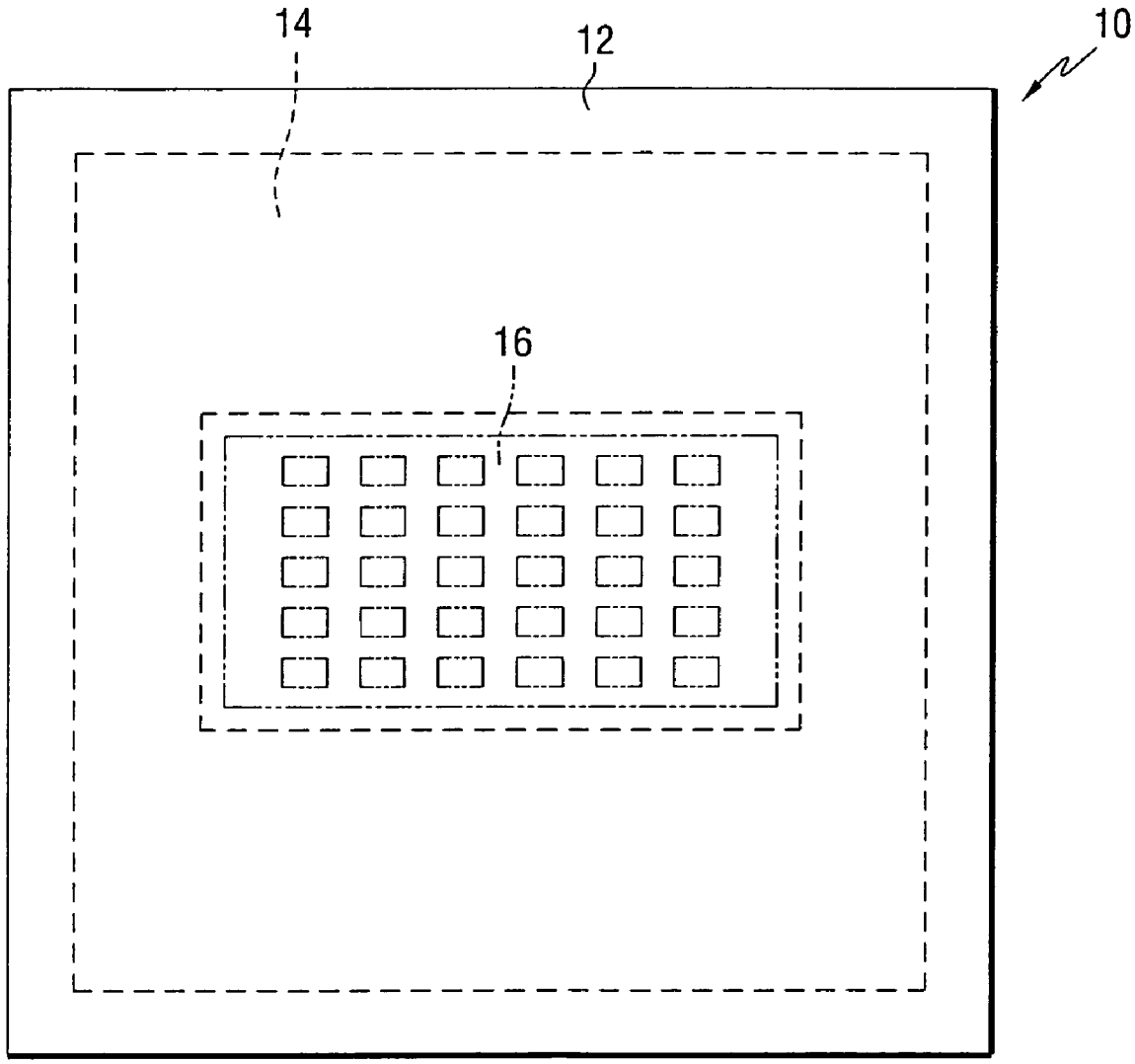
FIG. 1 is a top view of a protective cover in accordance with an embodiment of the present invention.
Figure 2:
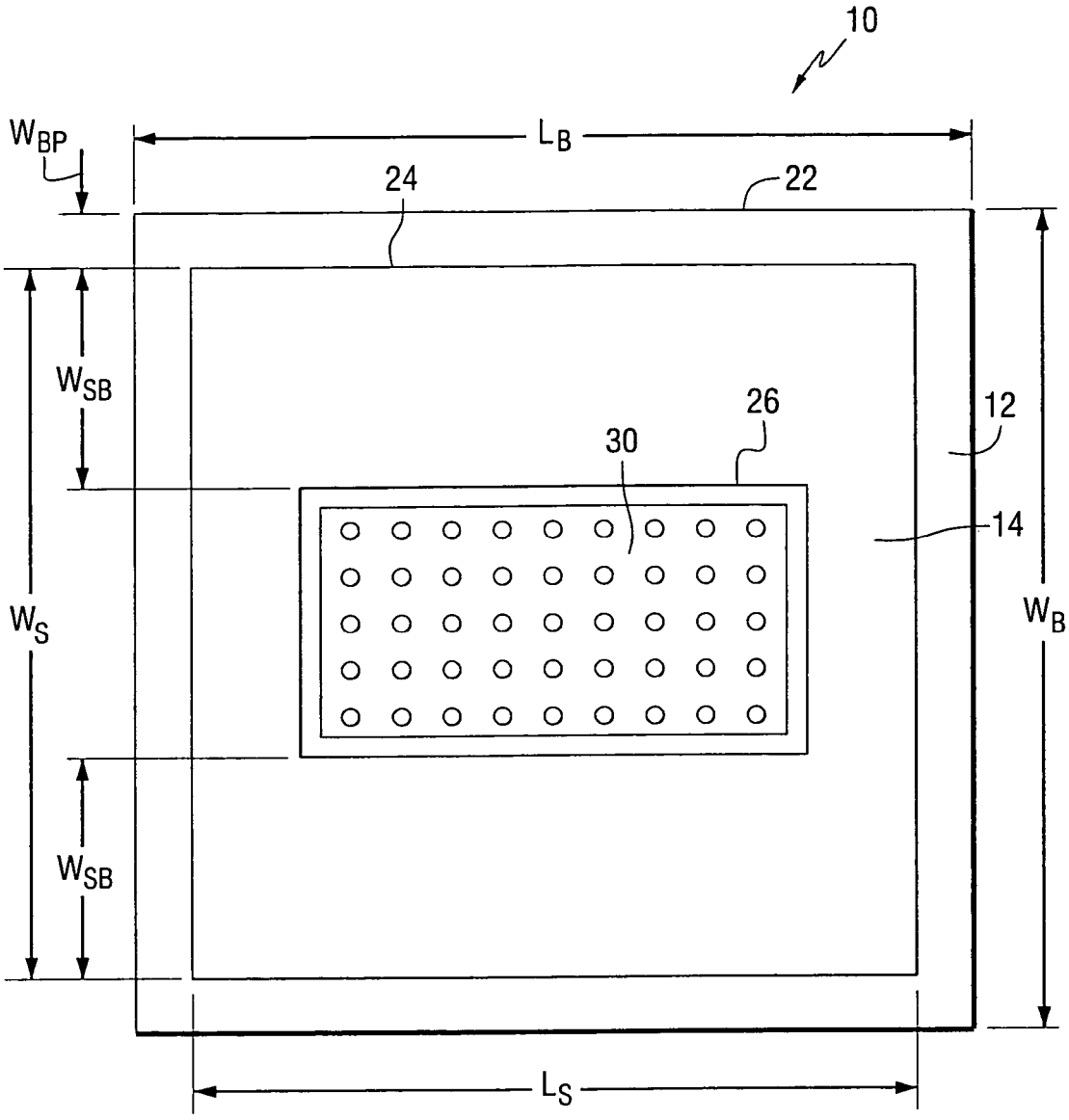
FIG. 2 is a bottom view of a protective cover in accordance with an embodiment of the present invention.
Figure 3:
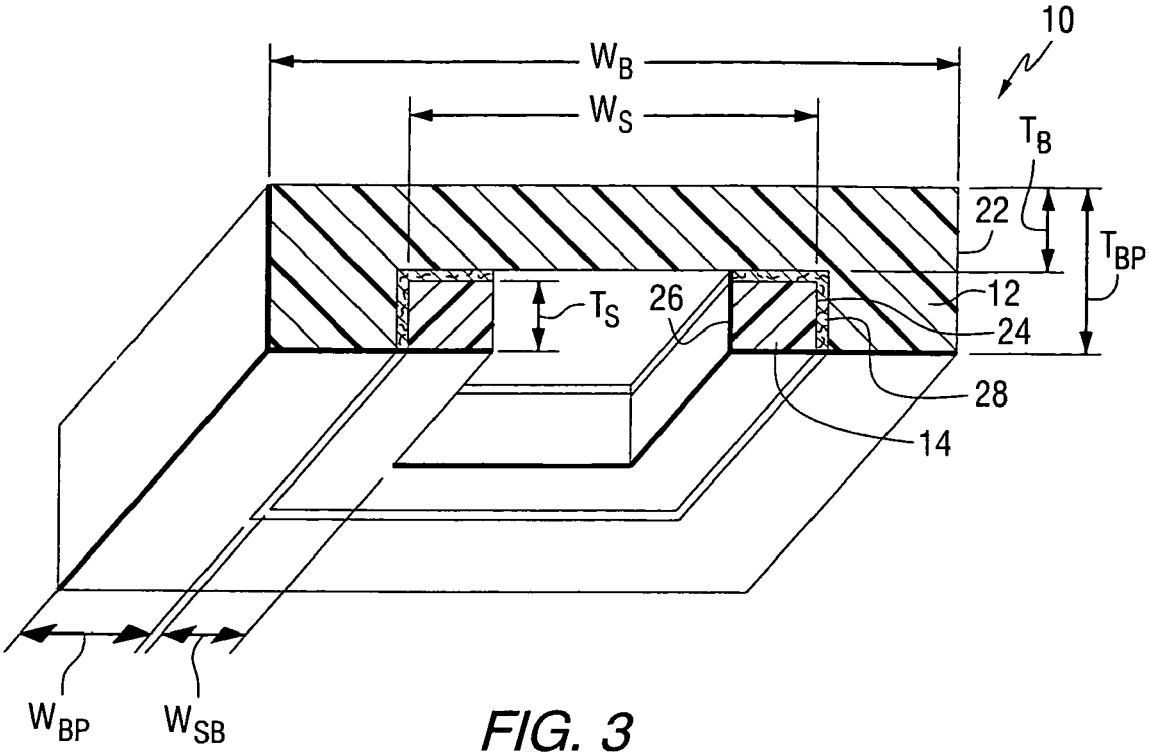
FIG. 3 is a cross-sectional perspective view of a protective cover in accordance with an embodiment of the present invention.
Figure 4:
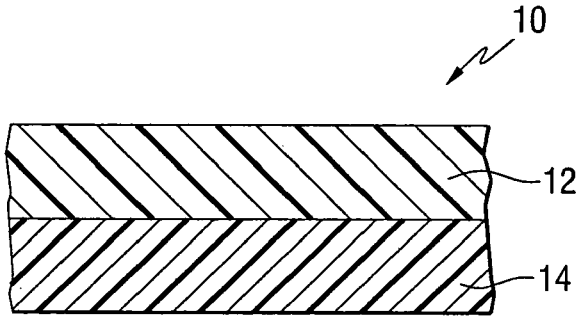
FIG. 4 is a cross-sectional view of a portion of a protective cover in accordance with an embodiment of the present invention.

FIG. 1 is a top view, FIG. 2 is a bottom view and FIG. 3 is an isometric cross sectional view of a temporary protective cover 10 in accordance with an embodiment of the present invention. The protective cover 10 includes a durable backing layer 12 and a pliable, tacky sealing layer 14 covering at least a portion of the underside of the durable backing layer 12. The protective cover 10 shown in FIGS. 1-3 is generally square in shape, however, any other suitable shape may be used such as rectangular, round, etc.

As shown in FIG. 1, the protective cover 10 can be positioned for installation over a drain 16 to prevent unwanted liquid from entering the drain. The protective cover 10 adheres to the surface surrounding a drain 16, forming a seal which is sufficient to prevent the flow of at least some liquid past the protective cover 10. The sealing layer 14 creates an effective seal even when the surface surrounding the drain is not smooth. The interior area of the durable backing layer 12 can directly cover the drain 16 while the pliable, tacky sealing layer 14 is provided in the form of a band that seals the protective cover 10 against the ground to prevent liquid from entering the drain 16. The protective cover 10 may be utilized to cover virtually any type of drain or hole 16 so long as at least a portion of the pliable, tacky sealing layer 14 of the protective cover 10 is sized to extend beyond the dimensions of the drain 16 and form a sufficient seal therearound. In one embodiment, the protective cover 10 can be positioned over relatively large areas, e.g., at least 1 square foot up to 25 square feet or more.

As shown in FIGS. 1-5, the pliable, tacky sealing layer 14 is provided adjacent the lower surface of the durable backing layer 12. The durable backing layer 12 is liquid impermeable, and is made of a flexible and durable material. The durable backing layer 12 can have a tensile strength at least 25 percent higher than the tensile strength of the tacky sealing layer 14. In one embodiment, the protective cover 10 has sufficient durability to be driven over by an industrial vehicle while positioned over a drain.

The durable backing layer 12 can comprise any suitable material such as natural rubber, synthetic rubber, nitrile rubber or vinyl, as well as reinforced fabric impregnated with and/or coated with rubber and/or vinyl. In one embodiment, the durable backing layer 12 may include a woven fabric surrounded by and encased in a durable and/or liquid impermeable material, which may include any of the previously mentioned materials. The durable backing layer 12 can include a tough, woven synthetic fabric molecularly coated with a liquid impermeable plastic-type compound that is minimally degradable even in adverse environments. In one embodiment, the durable backing layer 12 includes a geotextile material, such as that sold under the trade name XR-5®, and can be used to prevent the ingress of a wide range of harsh liquids. Geotextile materials are durable, flexible and exhibit good dimensional stability, tensile strength and puncture resistance. It should be understood, however, that the fabric of the durable backing layer 12 may include any natural or synthetic woven fabric and may include any natural or synthetic nonwoven fabrics.

The pliable, tacky sealing layer 14 is flexible and tacky such that it conforms to irregularities or roughness in the spill surface and adheres to the surface surrounding a drain to thereby provide a seal between the layer 14 and surface which reduces or eliminates the flow of spilled liquids. The pliable, tacky sealing layer 14 can comprise materials such as urethane, polyurethane, polyvinyl chloride and/or silicon. The pliable tacky layer 14 may have a hardness, as measured by a durometer, at least 25 percent less than the hardness of the durable backing layer 12. In one embodiment, the pliable, tacky sealing layer has a durometer hardness of less than 80 F. The pliable, tacky sealing layer 14 can comprise an inherently tacky material or can have a standard tackifier applied to any exposed surface. The pliable, tacky sealing layer 14 can have a tackiness such that it adheres to a surface surrounding a drain or hole to prevent the flow of liquid from entering the drain. In one embodiment, the pliable, tacky sealing layer 14 has sufficient tackiness such that the sealing layer adheres when pressed against a vertical wall. The tackiness of the sealing layer 14 may also be measured by other test methods known to those skilled in the art, such as rolling ball, peel and probe tests. The pliable, tacky sealing layer 14 may be permanently attached to the durable backing layer 12. Alternatively, the pliable, tacky sealing layer 14 may be removably mounted or adhered on the backing layer 12 to allow replacement of the pliable, tacky sealing layer. In another embodiment, a new pliable, tacky sealing layer may be adhered over an old pliable, tacky sealing layer if desired.

While a process is described below for manufacturing polyurethane having an inherent tackiness, one skilled in the art will appreciate that other materials, such as, for example, vinyls, silicons and rubbers, may also be modified to have an inherent tackiness. In one embodiment, a mixture of various polyurethanes can be used to make the sealing layer 14. A typical polyurethane mixture comprises from about 50 to about 80 weight percent polyol, and from about 20 to about 50 weight percent isocyanate. The liquid polyurethane is mixed and cured in a manner which gives it a moderate degree of inherent tackiness to all exposed surfaces of the polyurethane material. The molding and curing process creates a substantially smooth exposed surface, which may contain minor undulations. The polyurethane material is soft, yet resilient, and thus may be easily severed by a user with a knife. Surfaces of the polyurethane material which are exposed when a portion of it is severed can also be inherently tacky.

As shown in FIG. 2, the durable backing layer 12 can have a backing layer length $L_B$ of from about 1 foot to about 10 feet, and a backing layer width $W_B$ of from about 1 foot to about 10 feet. The sealing layer 14 has a sealing layer length $L_S$ of from about 1 foot to about 10 feet, and a sealing layer width $W_S$ of from about 1 foot to about 10 feet. For example, a protective cover 10 positioned over a drain 16 can have a backing layer length $L_B$ and width $W_B$, as well as a sealing layer length $L_S$ and width $W_S$, which are at least 2 or 3 inches greater than the length and width of the drain 16.

As shown in FIG. 2, in one embodiment of the present invention the durable backing layer 12 has a periphery 22, and the sealing layer 14 has a periphery 24 that is inside the periphery 22 of the durable backing layer 12. The distance between the peripheries 22 and 24 is labelled $W_{BP}$ in FIG. 2, and may be zero, or may be at least 0.25 inch, up to about 10 inches, or more. For example, $W_{BP}$ may be from 0.5 or 1 inch up to 5 inches.

In the embodiment shown in FIG. 2, the sealing layer 14 has an interior border 26 which defines a sealing layer band having a width $W_{SB}$ between the pliable, tacky sealing layer periphery 24 and the interior border 26. In one embodiment, the width of the band $W_{SB}$ sealing layer can be from about 1 inch to about 1 foot. Alternatively, the pliable, tacky sealing layer may cover the entire interior region of the durable backing layer 12 with no interior border.

As shown in FIG. 3, the durable backing layer 12 can have a relatively large thickness $T_{BP}$ at its periphery 22, and a relatively small thickness $T_B$ at its interior region. The thickness of the backing layer interior region $T_B$ can be from about 0.03 to about 0.25 inch, and the thickness of the backing layer periphery $T_{BP}$ can be from about 0.06 to about 0.5 inch. In one embodiment, the thickened peripheral portion can have a thickened portion width $W_{BP}$ of from about 0.25 inch to about 10 inches. A lower exposed surface of the thickened portion may be structured to contact the ground surrounding the drain. The pliable, tacky sealing layer 14 can have a sealing layer thickness $T_S$ of from about 0.03 to about 0.5 inch. In one embodiment, the pliable, tacky sealing layer 14 will be thinner than the durable backing layer 12, however, both the pliable tacky sealing layer 14 and the durable backing layer 12 may be of any thickness, including the same thickness, without departing from the spirit and scope of the present invention.

In one embodiment, the material at the periphery 22 of the backing layer 12 can have a weight per unit area that is greater than the weight per unit area of the remainder of the backing layer 12. By providing a thicker layer at the periphery 22 of the backing layer 12, a more effective seal may be formed around the drain or other hole.

In one embodiment, the exposed under surface of the sealing layer band can have a surface area of from about 1 square foot to about 25 square feet. Although the sealing layer band is shown in the figures as corresponding generally to the shape of the protective cover 10, in another embodiment the sealing layer band may define an alternative shape, such as a circular shape, which does not correspond to the shape of the protective cover 10. In this embodiment, since the pliable, tacky sealing layer 14 is provided only in the sealing layer band, the protective cover 10 may be lightweight and readily implemented for use in emergency situations, such as where hazardous liquids are accidentally spilled near a drain opening. Further, both the durable layer 12 and the pliable, tacky sealing layer 14 will resist water, oil and many chemicals making the protective cover 10 suitable for use in many types of work environments, including hazardous work environments. The protective cover 10 is readily reusable and cleans up easily with soap and water.

Figure 5:
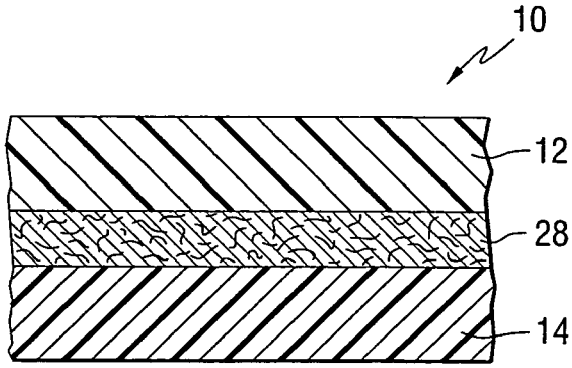
FIG. 5 is a cross-sectional view of a portion of a protective cover in accordance with another embodiment of the present invention.

As shown in FIGS. 3 and 5, the durable backing layer 12 and the pliable, tacky sealing layer 14 can optionally include a fiber layer 28 disposed therebetween to assist in the adhesion of the pliable, tacky sealing layer 14 to the durable backing layer 12. The fiber layer 28 can comprise a woven or non-woven fiber material, such as needlepunch or other oriented fiber materials, which are disposed between the pliable, tacky sealing layer 14 and the durable backing layer 12. In one embodiment, non-woven fibers can be deposited on the surface of the durable backing layer 12 before it is cured so that the fibers are at least partially embedded within the durable backing layer 12. The fibers can be blown or otherwise deposited onto the surface of the uncured durable backing layer 12. The fibers can comprise cellulosic or non-cellulosic materials, such as polyester, polyethylene, nylon or the like. Once the fibers are embedded within the durable backing layer 12, the pliable, tacky sealing layer 14 can be applied to the exposed surface of the durable backing layer 12 including the fibers. As the pliable, tacky sealing layer 14 cures, the fiber layer 28 improves adhesion between the durable backing layer 12 and the pliable, tacky sealing layer 14. In one embodiment, the fiber layer 28 is particularly useful in improving the adhesion between a rubber durable backing layer 12 and a urethane pliable, tacky sealing layer 14.

As shown in FIG. 2, in order to add stability to the protective cover 10, a stabilizing mat 30 may be provided under the durable backing layer 12 within the interior border 26 of the pliable, tacky sealing layer band 14. The stabilizing mat 30 may be made of any of the materials previously described for the durable backing layer 12 or the pliable, tacky sealing layer 14, or may be made from a different material. The lower exposed surface of the stabilizing mat 30 may or may not be tacky. Preferably, the stabilizing mat 30 will be flexible so that the protective cover 10 may be rolled or folded for storage. However, the stabilizing mat 30 may be made of a rigid material without departing from the spirit and scope of the present invention. Further, while the stabilizing mat 30 shown in FIG. 2 has an array of cylindrical projections on its underside, such projections may be eliminated or provided in any other shape or configuration, such as a cross or an "X".

The protective cover can form an effective seal around a drain, is generally lightweight, and is capable of quick and easy implementation even for large drains. The protective cover is readily reusable and transportable, and may be quickly implemented to seal a drain and/or hole in an emergency situation. The protective cover may be implemented for use with a variety of different types and sizes of drains and/or holes, and forms a tight seal around the drain/hole to block out unwanted liquids from entering the drain or hole.

Whereas particular embodiments of this invention have been described above for purposes of illustration, it will be evident to those skilled in the art that numerous variations of the details of the present invention may be made without departing from the invention as defined in the appended claims.

The invention claimed is:

1. A protective cover for installation over a drain comprising:

a durable backing layer having a periphery; and a pliable, tacky sealing layer adjacent a portion of the durable backing layer structured and arranged to block spills from entering the drain having a periphery inside the periphery of the durable backing layer; and wherein the pliable, tacky sealing layer has an interior border defining a sealing layer band between the interior border and the periphery of the pliable, tacky sealing layer, and the sealing layer band has a width of from 1 inch to 1 foot.

2. A protective cover for installation over a drain comprising:

a durable rubber backing layer having a periphery and a thickened portion adjacent the periphery; and a pliable, tacky urethane sealing layer structured and arranged to block spills from entering the drain adjacent a portion of the durable rubber backing layer, the pliable, tacky urethane sealing layer having a periphery inside the periphery of the durable rubber backing layer; and wherein the pliable, tacky sealing layer has an interior border defining a sealing layer band between the interior border and the periphery of the pliable, tacky sealing layer.

3. The protective cover of claim 1, wherein at least a portion of the periphery of the pliable, tacky sealing layer is at least 0.25 inch inside the periphery of the durable backing layer.

4. The protective cover of claim 1 wherein the durable backing layer has an interior region and a thickened portion adjacent the periphery of the durable backing layer.

5. The protective cover of claim 4, wherein the interior region has a thickness of from 0.03 to 0.25 inch and the thickened portion has a thickness of from 0.06 to 0.5 inch.

6. The protective cover of claim 5, wherein the thickened portion has a bottom surface having a surface area of from 1 to 25 square feet.

7. The protective cover of claim 1, wherein the durable backing layer has a length of at least 1 foot and a width of at least 1 foot.

8. The protective cover of claim 1, wherein the durable backing layer comprises natural rubber, synthetic rubber, nitrile rubber, vinyl, and/or reinforced fabric impregnated with and/or coated with rubber and/or vinyl.

9. The protective cover of claim 1, wherein the pliable, tacky sealing layer has a thickness of from 0.03 to 0.5 inch.

10. The protective cover of claim 1, wherein the pliable, tacky sealing layer has a length of at least 1 foot and a width of at least 1 foot.

11. The protective cover of claim 1, wherein the pliable, tacky sealing layer has a durometer hardness of less than 80 F.

12. The protective cover of claim 1, further comprising a stabilizing mat adhered to an interior region of the durable backing layer.

13. The protective cover of claim 2, wherein the durable rubber backing layer further comprises an interior region having a thickness of from 0.03 to 0.25 inch and the thickened portion has a thickness of from 0.06 to 0.5 inch.

14. The protective cover of claim 2, wherein the thickened portion has a bottom surface having a surface area of from 1 to 25 square feet.

15. The protective cover of claim 2, wherein the pliable, tacky sealing layer has a thickness of from 0.03 to 0.5 inch.

16. The protective cover of claim 2, wherein at least a portion of the periphery of the pliable, tacky sealing layer is at least 0.25 inch inside the periphery of the durable backing layer.

17. The protective cover of claim 2, wherein the durable backing layer has a length of at least 1 foot and a width of at least 1 foot.

18. The protective cover of claim 2, wherein the durable backing layer comprises natural rubber, synthetic rubber, nitrile rubber, vinyl, and/or reinforced fabric impregnated with and/or coated with rubber and/or vinyl.

19. The protective cover of claim 2, wherein the pliable, tacky sealing layer has a durometer hardness of less than 80 F.

20. The protective cover of claim 2, further comprising a stabilizing mat adhered to an interior region of the durable backing layer.

* * * * *